US005727505A

United States Patent [19]

Herr et al.

[11] Patent Number: 5,727,505

[45] Date of Patent: Mar. 17, 1998

[54] APPARATUS FOR SEPARATING WATER AND STEAM

[75] Inventors: Wolfgang Herr, Hirschaid; Günther Pröbstle, Erlangen; Wolfgang Vollmer, Erlangen; Eberhard Wittchow, Erlangen, all of Germany

[73] Assignee: Siemens Aktiengesellschaft, Munich, Germany

[21] Appl. No.: 399,891

[22] Filed: Mar. 7, 1995

Related U.S. Application Data

[63] Continuation of PCT/DE93/00774 Aug. 25, 1993.

[30] Foreign Application Priority Data

Sep. 7, 1992 [DE] Germany ..... 42 29 847.4

[51] Int. Cl.[6] ..... F22B 1/02

[52] U.S. Cl. ..... 122/34; 122/488; 122/489; 122/492; 96/193; 210/188

[58] Field of Search ..... 122/34, 488, 489, 122/490, 491, 492; 96/155, 193, 194; 210/188

[56] References Cited

U.S. PATENT DOCUMENTS

| | | | |
|---|---|---|---|
| 522,416 | 7/1894 | Iles | 122/34 |
| 4,069,154 | 1/1978 | Barloy | 96/193 |

FOREIGN PATENT DOCUMENTS

| | | |
|---|---|---|
| 517070 | 1/1931 | Germany . |
| 859736 | 3/1951 | Germany . |
| 1576878 | 5/1970 | Germany . |
| 1 576 879 | 3/1972 | Germany . |

*Primary Examiner*—Henry A. Bennett
*Assistant Examiner*—Jiping Lu
*Attorney, Agent, or Firm*—Herbert L. Lerner; Laurence A. Greenberg

[57] ABSTRACT

An apparatus for separating water and steam in a water-steam mixture includes two collectors being disposed horizontally at different heights and being connected together by a connecting pipe. In addition to the connecting pipe, the first collector situated at the bottom has an inlet pipe for the water-steam mixture and as well as a water outlet pipe for the separated water. The second collector lying thereabove includes a steam outlet pipe for the separated steam, in addition to the connecting pipe. The apparatus, which works in accordance with the gravity separation principle, is particularly thermally resilient and therefore permits reliable operation even with large temperature gradients.

7 Claims, 2 Drawing Sheets

APPARATUS FOR SEPARATING WATER AND STEAM

CROSS-REFERENCE TO RELATED APPLICATION:

This application is a Continuation of International Application Ser. No. PCT/DE93/00774, filed Aug. 25, 1993.

BACKGROUND OF THE INVENTION:

1. Field of the Invention:

The invention relates to an apparatus for separating water and steam in a water-steam mixture, having two collectors being disposed horizontally at different heights and being connected together by a connecting pipe, in addition to the connecting pipe, the first collector situated at the bottom has an inlet pipe for the water-steam mixture and a water outlet pipe for the separated water, and the second collector lying thereabove has a steam outlet pipe for the separated steam.

Such an apparatus which is known, for example, from German Patent DE-PS 859 736, is usually employed in the evaporation system of a steam generator. During the starting or load-changing operation of a steam generator of that kind large amounts of water generally accumulate in the evaporation system. The water is usually separated in a water-steam drum provided downstream of the evaporator heating surfaces of the evaporation system, as is seen in the direction of flow of a water-steam circuit. Since a water-steam drum of that kind has a great wall thickness because of the high steam pressure prevailing in it and because of the large inside diameter, the permissible rate of temperature variation in starting and load-changing operation is greatly restricted. It is also known from German Published, Non-Prosecuted Applications DE-OS 1 576 878 and DE-OS 1 576 879 to effect the separation of water from steam inside a collector. However, that known apparatus works in a particularly complicated manner in accordance with the centrifugal separation principle, with the collector containing laterally closed tubular bodies which have tangentially entering supply pipes for the water-steam mixture.

SUMMARY OF THE INVENTION:

It is accordingly an object of the invention to provide an apparatus for separating water and steam, which overcomes the hereinafore-mentioned disadvantages of the heretofore-known devices of this general type, which is particularly simple and which has adequate thermal resilience even in the event of large temperature variations.

With the foregoing and other objects in view there is provided, in accordance with the invention, an apparatus for separating water and steam in a water-steam mixture, comprising a first collector having a number of inlet pipes for a water-steam mixture and a water outlet pipe for separated water; a second collector disposed horizontally above the first collector and having a number of steam outlet pipes for separated steam; a connecting pipe interconnecting the collectors; the first and second collectors having regions adjacent the connecting pipe; and the inlet pipes for the water-steam mixture and the steam outlet pipes being positioned for leaving the regions of the first and second collectors free of pipes.

The apparatus according to the invention works in accordance with the gravity separation principle, with the configuration of the two collectors at different heights enabling particularly good separation of water and steam to be achieved in a simple manner.

In accordance with another feature of the invention, at least four inlet pipes for the water-steam mixture in each case are formed into a group. In order to ensure an adequate residence time for the water-steam mixture inside the separation apparatus, the distance between the inlet pipes within a group is shorter than the distance between each inlet pipe and the connecting pipe interconnecting the collectors.

In accordance with a further feature of the invention, the inlet pipe or each inlet pipe is curved about an axis lying above the entry into the first collector. Through the use of this kind of a curvature of the inlet pipe or of each inlet pipe, at least in the region of the entry into the first collector, the effect is achieved that a preliminary separation of the water is already effected inside an inlet pipe through water enrichment in the bottom region of the pipe.

In accordance with an added feature of the invention, this effect is further intensified if the center line of the inlet pipe or of each inlet pipe at the entry into the first collector forms an angle of inclination with the horizontal which is smaller than or equal to 60°.

In accordance with an additional feature of the invention, in order to discharge water entrained with the steam into the second collector, there is provided a return pipe having one end which is connected to the second collector in a bottom region of the latter and another end which is connected to the water outlet pipe of the first or bottom collector.

In accordance with yet another feature of the invention, in order to enable the separated water to be fed back to the water-steam circuit in a suitable manner, there is provided a third collector into which the water outlet pipe of the first collector opens. The third collector may advantageously be disposed horizontally underneath the first collector.

In accordance with yet a further feature of the invention, the second and third collectors are connected together by means of a pipe.

In accordance with a concomitant feature of the invention, the steam outlet pipes of the second collector are also formed into groups, with each group including at least two and preferably four steam outlet pipes. It is thereby ensured that no water will be entrained with the steam passing out of the second collector, which also acts as a distributor, while steam formed in the second collector is able to be appropriately distributed to downstream heating surfaces.

Other features which are considered as characteristic for the invention are set forth in the appended claims.

Although the invention is illustrated and described herein as embodied in an apparatus for separating water and steam, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
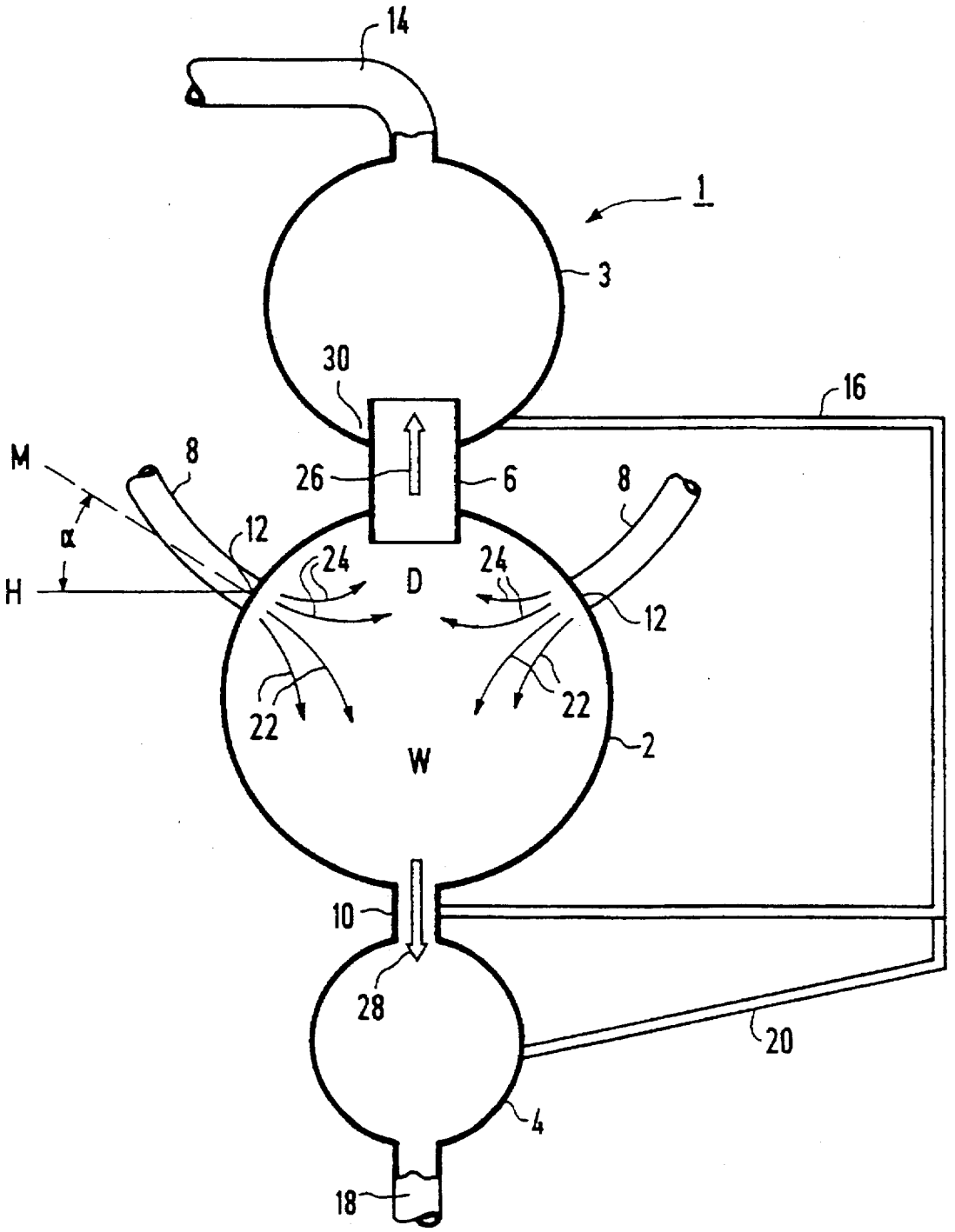
FIG. 1 is a fragmentary, diagrammatic, cross-sectional view of an apparatus for separating water and steam, including three collectors which are disposed one above the other and are connected together.

DESCRIPTION OF THE PREFERRED EMBODIMENTS:

Referring now in detail to the figures of the drawing, in which parts corresponding to one another are given the same reference numerals, and first, particularly, to FIG. 1 thereof, there is seen an embodiment of an apparatus 1 according to the invention which includes first, second and third collectors 2, 3 and 4 that have a cylindrical configuration and are disposed horizontally at different heights, that is to say one above the other. The apparatus 1 is used for gravity separation of water and steam in a water-steam mixture which collects, for example, downstream of a non-illustrated evaporation system of a steam generator.

The first collector 2, which will also be referred to below as a separator collector, is provided with a number of inlet pipes 8 and with a water outlet pipe 10 in addition to a connecting pipe 6. The inlet pipes 8 extend upwards in a curve, that is to say they are curved about an axis situated above entries 12 leading into the separator collector 2. A center line M of the inlet pipe 8 or of each inlet pipe 8 at the entry 12 into the separator collector 2 forms an angle of inclination $\alpha$ with the horizontal H which is smaller than or equal to 60°.

The second collector 3, which will also be referred to below as a steam distributor, is connected by means of the connecting pipe 6 to the separator collector 2 lying below it. In addition, the steam distributor is provided with a number of steam outlet pipes 14, of which only one can be seen in FIG. 1. The steam distributor 3 is connected by a return pipe 16 to the water outlet pipe 10.

The third collector 4, which will also be referred to below as an additional collector, is disposed beneath the separator collector 2. A pipe 20 is connected to the return pipe 16 and is connected to the additional collector 4, which is provided with an outlet pipe 18. The additional collector 4 is thus connected through the pipes 16 and 20 to the steam distributor 3.

During the operation of the separation apparatus 1, the water-steam mixture flows through the inlet pipes 8 into the separator collector 2. As is indicated by arrows 22 and 24, water W and steam D are separated from one another there. The steam D flows in the direction of an arrow 26 through the connecting pipe 6 into the steam distributor 3. The water W flows in the direction of an arrow 28 through the water outlet pipe 10 into the additional collector 4. The water is returned from the additional collector 4 through the outlet pipe 18 to a water-steam circuit.

In order to be able to discharge the entrained water W into the steam distributor 3 with the steam D, the connecting pipe 6 projects into the interior of the steam distributor 3 to form a channel 30. The return pipe 16 is therefore connected to the steam distributor 3 in a bottom region of the channel 30.

Due to the curved, inclined path followed by the inlet pipes 8, a separation of the water W already takes place to a certain extent inside the inlet pipes 8 through the action of centrifugal force and gravity. At the same time the water-steam mixture is enriched with water W in the bottom region of the inlet pipes 8.

Figure 2:
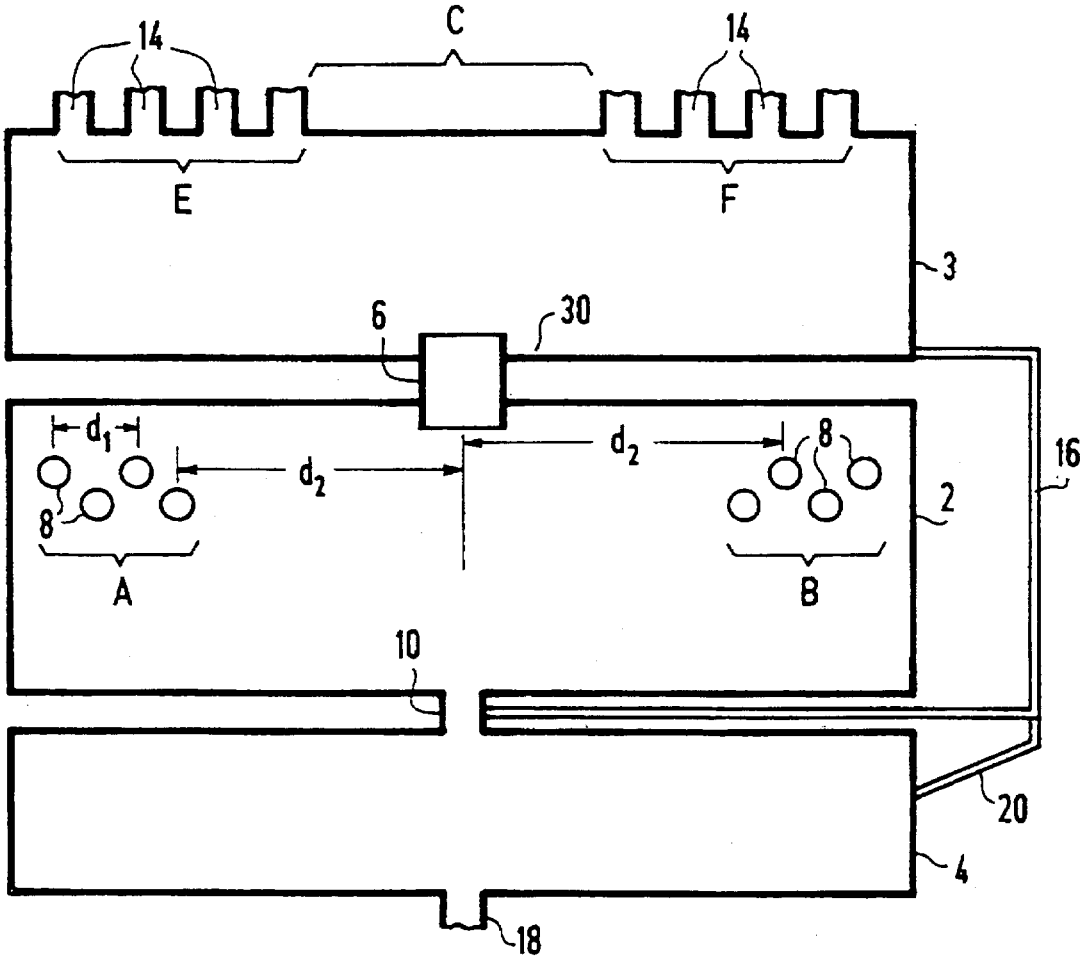
FIG. 2 is a longitudinal-sectional view of the apparatus of FIG. 1.

FIG. 2 shows groups A and B each having four inlet pipes 8 provided on a respective side of the connecting pipe 6. A distance $d_1$ between two inlet pipes 8 of a group A, B is smaller than a distance $d_2$ between each inlet pipe 8 and the connecting pipe 6 interconnecting the two collectors 2 and 3. As is shown in FIG. 2, the distances $d_1$, $d_2$ in each case relates to the center lines of the pipes 6, 8.

The steam outlet pipes 14 of the steam distributor 3 are likewise disposed in groups E, F and are disposed in such a way that no outlet opening of a steam outlet pipe 14 lies opposite the connecting pipe 6. In other words, a region C of the steam distributor 3 lying opposite the connecting pipe 6 is free of steam outlet pipes 14.

While the steam D is first distributed through the steam outlet pipes 14 to non-illustrated downstream heating surfaces connected in the water-steam circuit, the water W is returned, either directly through the water outlet pipe 10 or through the additional collector 4 which is only optionally provided, into the water-steam circuit.

We claim:

1. An apparatus for separating water and steam in a water-steam mixture, comprising:

a first collector having a number of inlet pipes for a water-steam mixture and a water outlet pipe for separated water;

a second collector disposed horizontally above said first collector and having a number of steam outlet pipes for separated steam;

a connecting pipe interconnecting said first and second collectors;

said first and second collectors having regions adjacent said connecting pipe;

a third collector disposed horizontally below said first collector, said water outlet pipe of said first collector opening into said third collector;

a pipe interconnecting said second collector and said third collector; and said inlet pipes for the water-steam mixture and said steam outlet pipes being positioned for leaving said regions of said first and second collectors free of pipes.

2. The apparatus according to claim 1, wherein at least each four of said inlet pipes for the water-steam mixture are formed into a group, defining a distance between said inlet pipes within a group being shorter than a distance between each of said inlet pipes and said connecting pipe interconnecting said collectors.

3. The apparatus according to claim 1, wherein said inlet pipes have entries leading into said first collector, and at least one of said inlet pipes is curved about an axis lying above at least one of said entries.

4. The apparatus according to claim 1, wherein said inlet pipes have entries leading into said first collector, and said inlet pipes have center lines at least one of which forms an angle of inclination with the horizontal being at most equal to 60°.

5. The apparatus according to claim 1, wherein said second collector has a bottom region, and including a return pipe having one end connected to said bottom region of said second collector and another end connected to said water outlet pipe of said first collector.

6. The apparatus according to claim 1, wherein said steam outlet pipes of said second collector are formed into groups, and each of said groups includes at least two steam outlet pipes.

7. The apparatus according to claim 1, wherein said steam outlet pipes of said second collector are formed into groups, and each of said groups includes four steam outlet pipes.

* * * * *